US009160147B2

(12) United States Patent
Yoshida et al.

(10) Patent No.: US 9,160,147 B2
(45) Date of Patent: Oct. 13, 2015

(54) SPARK PLUG AND MANUFACTURING METHOD FOR SAME

(75) Inventors: Haruki Yoshida, Tajimi (JP); Toshitaka Honda, Aichi (JP); Houju Fukushima, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 339 days.

(21) Appl. No.: 13/824,448

(22) PCT Filed: Sep. 7, 2011

(86) PCT No.: PCT/JP2011/005023

§ 371 (c)(1), (2), (4) Date: Mar. 18, 2013

(87) PCT Pub. No.: WO2012/042758

PCT Pub. Date: Apr. 5, 2012

(65) Prior Publication Data

US 2013/0175922 A1 Jul. 11, 2013

(30) Foreign Application Priority Data

Oct. 1, 2010 (JP) ..... 2010-224264

(51) Int. Cl.

| | |
|---|---|
| ***H01T 13/20*** | (2006.01) |
| ***H01T 13/40*** | (2006.01) |
| ***H01T 13/34*** | (2006.01) |
| ***H01T 13/41*** | (2006.01) |
| ***H01T 21/02*** | (2006.01) |

(52) U.S. Cl.

CPC ..... *H01T 13/40* (2013.01); *H01T 13/20* (2013.01); *H01T 13/34* (2013.01); *H01T 13/41* (2013.01); *H01T 21/02* (2013.01)

(58) Field of Classification Search

CPC ..... H01T 13/022; H01T 13/34; H01T 13/41
USPC ..... 315/58; 313/141, 143, 145; 445/7
See application file for complete search history.

(56) References Cited

U.S. PATENT DOCUMENTS

| | | | | |
|---|---|---|---|---|
| 3,567,658 | A | 3/1971 | Webb et al. | 252/506 |
| 4,112,330 | A | 9/1978 | Stimson et al. | 315/46 |
| 4,173,731 | A | 11/1979 | Takagi et al. | 315/58 |
| 4,601,848 | A | 7/1986 | Sakai et al. | 252/503 |
| 6,160,342 | A | 12/2000 | Nishikawa et al. | 313/141 |

(Continued)

FOREIGN PATENT DOCUMENTS

| | | | |
|---|---|---|---|
| CN | 1237021 A | 12/1999 | H01T 13/20 |
| JP | 2005-327743 | 11/2005 | H01T 13/20 |

(Continued)

OTHER PUBLICATIONS

Search Report issued in corresponding European Patent Application No. 11828325.8, dated Jan. 7, 2015.

(Continued)

*Primary Examiner* — Hai L Nguyen
(74) *Attorney, Agent, or Firm* — Kusner & Jaffe

(57) ABSTRACT

A spark plug having excellent load life performance, and a method of manufacturing the same, the spark plug having a connecting portion which electrically connects a center electrode and a metallic terminal within the axial hole of an insulator, the connecting portion including a resistor whose porosity is 5.0% or less.

14 Claims, 5 Drawing Sheets

(56) References Cited

U.S. PATENT DOCUMENTS

| | | | | |
|---|---|---|---|---|
| 6,188,166 | B1 | 2/2001 | Nishikawa et al. | 313/141 |
| 6,909,226 | B2 * | 6/2005 | Suzuki | 313/143 |
| 2010/0264823 | A1 | 10/2010 | Suzuki et al. | 315/71 |

FOREIGN PATENT DOCUMENTS

| | | | |
|---|---|---|---|
| JP | 2009-245716 | 10/2009 | H01T 13/20 |
| JP | 2010-123626 | 6/2010 | H01C 7/00 |

OTHER PUBLICATIONS

Chinese Office Action issued in corresponding Chinese patent application dated Nov. 1, 2013, including English translation; 14 pages.

* cited by examiner (FIRST STEP)

(SECOND STEP)

(THIRD STEP)

(FOURTH STEP)

SPARK PLUG AND MANUFACTURING METHOD FOR SAME

FIELD OF THE INVENTION

The present invention relates to a spark plug used for igniting an internal combustion engine and a method of manufacturing the same. Specifically, the present invention relates to a spark plug having a resistor incorporated therein and a method of manufacturing the same.

BACKGROUND OF THE INVENTION

In general, a spark plug used for igniting an internal combustion engine such an automotive engine includes a tubular metallic shell; a tubular insulator disposed in the bore of the metallic shell; a center electrode disposed in a forward end portion of the axial hole of the insulator; a metallic terminal disposed in a rear end portion of the axial hole; and a ground electrode whose one end is joined to the forward end of the metallic shell and whose other end faces the center electrode so as to form a spark discharge gap. Further, there has been known a spark plug including a resistor which is disposed in the axial hole between the center electrode and the metallic terminal so as to eliminate radio noise which would otherwise be generated when the engine is operated.

Incidentally, recent internal combustion engines for automobiles or the like have been required to produce a higher power and to operate with a higher efficiency, and development of a spark plug of a reduced size has been demanded in order to allow free design of engines and a reduction in the size of engines themselves. In order to reduce the size of a spark plug, the diameter of the bore of the insulator must be decreased. However, in the case of a spark plug designed in a conventional manner, decreasing the diameter of the insulator may deteriorate load life performance and decrease the fixing strength of the metallic terminal to the insulator.

Japanese Patent Application Laid-Open (kokai) No. 2009-245716 discloses a spark plug which can solve such a problem. In Japanese Patent Application Laid-Open (kokai) No. 2009-245716, there is recited a "spark plug characterized in that the diameter D of the electrically conductive glass seal layer is 3.3 mm or less, and the joint surface between the electrically conductive glass seal layer and the resistor is formed to have a curved shape." Japanese Patent Application Laid-Open (kokai) No. 2009-245716 states that, the invention can provide a "spark plug which is enhanced in adhesion between the resistor and the electrically conductive glass seal layer, which is excellent in vibration resistance and load life performance of the resistor, and which has a reduced diameter" (see paragraph 0012).

SUMMARY OF THE INVENTION

The present invention provides a spark plug which is excellent in load life performance and a method of manufacturing the same.

Means for solving the above-described problems is as follows.

(i) A spark plug comprising:

an insulator having an axial hole extending in a direction of an axis;

a center electrode held at one end of the axial hole;

a metallic terminal held at the other end of the axial hole; and a connecting portion which electrically connects the center electrode and the metallic terminal within the axial hole, the spark plug being characterized in that the connecting portion includes a resistor having a porosity of 5.0% or less.

Preferred modes of the spark plug (i) are as follows:

(ii) the porosity of the resistor is 4.0% or less;

(iii) a connecting portion diameter (B), which is a diameter of the axial hole at a position where the resistor is disposed, is 2.9 mm or less, and the porosity of the resistor is 1.2% or less;

(iv) the metallic terminal has a second constituent portion which is accommodated in the axial hole;

when, with the side of the axial hole at which the metallic terminal is held being defined as the rear end side with respect to the direction of the axis, a length from the rear end of the center electrode to the rear end of a connecting member which constitutes the connecting portion is referred to as a charging length (D) and a length from the rear end of the center electrode to the forward end of the second constituent portion is referred to as a connecting portion length (C), a shrinkage percentage $((D-C)/D)\times100$ which represents the ratio of the difference between the charging length (D) and the connecting portion length (C) to the charging length (D) falls within a range of 38% to 67%; and (v) a connecting portion diameter (B), which is a diameter of the axial hole at a position where the resistor is disposed, is 2.9 mm or less.

Another means for solving the above-described problems is as follows.

(vi) A spark plug comprising:

an insulator having an axial hole extending in a direction of an axis;

a center electrode held at one end of the axial hole;

a metallic terminal which has a second constituent portion accommodated in the axial hole and which is held at the other end of the axial hole; and a connecting portion which electrically connects the center electrode and the metallic terminal within the axial hole and which includes at least a resistor, the spark plug being characterized in that when, with the side of the axial hole at which the metallic terminal is held being defined as the rear end side with respect to the direction of the axis, a length from the rear end of the center electrode to the rear end of a connecting member which constitutes the connecting portion is referred to as a charging length (D) and a length from the rear end of the center electrode to the forward end of the second constituent portion is referred to as a connecting portion length (C), a shrinkage percentage $((D-C)/D)\times100$ which represents the ratio of the difference between the charging length (D) and the connecting portion length (C) to the charging length (D) is 35% or greater.

Preferred modes of the spark plug (vi) are as follows:

(vii) the shrinkage percentage $((D-C)/D)\times100$ is 69% or less;

(viii) the connecting portion diameter (B), which is a diameter of the axial hole at a position where the resistor is disposed, is 2.9 mm or less, and the shrinkage percentage $((D-C)/D)\times100$ falls within a range of 38% to 67%; and (ix) the connecting portion includes a resistor having a porosity of 5.0% or less.

A preferred mode of the spark plug (i) or (vi) is as follows:

(x) a forward end portion of the second constituent portion has an uneven surface; and the ratio (A/B) of a forward end portion diameter (A), which is a diameter of the forward end portion, to the connecting portion diameter (B) falls within a range of 0.85 to 0.97.

Another means for solving the above-described problems is as follows.

(xi) A method of manufacturing a spark plug which includes:

an insulator having an axial hole extending in a direction of an axis;

a center electrode held at one end of the axial hole;

a metallic terminal which has a first constituent portion exposed from the axial hole and which is held at the other end of the axial hole; and a connecting portion which electrically connects the center electrode and the metallic terminal within the axial hole, the method being characterized by comprising:

a first step of disposing the center electrode at the one end of the axial hole;

a second step of charging a connecting portion forming powder for forming the connecting portion;

a third step of disposing a forward end portion of the metallic terminal in the axial hole such that the forward end portion comes into contact with the connecting portion forming powder; and a fourth step of heating the connecting portion forming powder and applying a load thereto through the metallic terminal, wherein when, with the side of the axial hole at which the center electrode is disposed being defined as the forward end side with respect to the direction of the axis, a length from the rear end of the insulator to the forward end of the first constituent portion in the direction of the axis is referred to as an exposure length (H) (mm) and a diameter of the axial hole at a position where the connecting portion forming powder is disposed is referred to as a powder portion diameter (B') (mm), in the third step, the exposure length (H) and the powder portion diameter (B') satisfy the following relational expressions (1) to (3):

$$H \geq -3.1B' + 18 \quad (1)$$

$$H \geq -0.85B' + 11 \quad (2)$$

$$B' \leq 5. \quad (3)$$

Preferred modes of the method (xi) are as follows:

(xii) the exposure length (H) (mm) and the powder portion diameter (B') (mm) satisfy a relational expression $H \leq 2.0B' + 22.4$;

(xiii) the powder portion diameter (B') (mm) satisfies a relational expression $B' \leq 2.9$;

(xiv) the exposure length (H) (mm) and the powder portion diameter (B') (mm) satisfy a relational expression $H \geq -3.1B' + 19$; and (xv) a forward end portion of the metallic terminal has an uneven surface, and the ratio (A/B') of a forward end portion diameter (A), which is a diameter of the forward end portion, to the powder portion diameter (B') falls within a range of 0.85 to 0.97.

The spark plug of the first invention includes a resistor whose porosity is 5.0% or less, in particular, 4.0% or less. Therefore, there can be provided a spark plug which is excellent in load life performance.

The spark plug of the first invention includes a resistor whose porosity is 1.2% or less when the connecting portion diameter (B) is 2.9 mm or less. Therefore, there can be provided a spark plug which is more excellent in load life performance.

In the case of the spark plug of the first invention, the shrinkage percentage $((D-C)/D)\times 100$ falls within a range of 38% to 67%. Therefore, there can be provided a spark plug which is excellent in terms of load life performance and the fixing strength of the metallic terminal to the insulator. Also, there can be provided a spark plug which is reduced in the incidence of defectives due to breakage of the insulator which occurs when the metallic terminal is inserted into the axial hole of the insulator so as to apply a load to the connecting portion forming powder for forming the connecting portion.

In the case of the spark plug of the first invention, when the connecting portion diameter (B) is set to 2.9 mm or less, the effect of improving load life performance is enhanced.

In the case of the spark plug of the second invention, the shrinkage percentage $((D-C)/D)\times 100$ is 35% or greater. Therefore, there can be provided a spark plug which is excellent in terms of load life performance and the fixing strength of the metallic terminal to the insulator.

In the case of the spark plug of the second invention, the shrinkage percentage $((D-C)/D)\times 100$ is 69% or less. Therefore, there can be provided a spark plug which is reduced in the incidence of defectives due to breakage of the insulator which occurs when the metallic terminal is inserted into the axial hole of the insulator so as to apply a load to the connecting portion forming powder for forming the connecting portion.

In the case of the spark plug of the second invention, when the connecting portion diameter (B) is 2.9 mm or less, the shrinkage percentage $((D-C)/D)\times 100$ is set such that it falls within a range of 38% to 67%, in particular, it becomes 45% or less. Therefore, there can be provided a spark plug which is more excellent in terms of load life performance and the fixing strength of the metallic terminal to the insulator. Also, there can be provided a spark plug which is more reduced in the incidence of defectives due to breakage of the insulator which occurs when the metallic terminal is inserted into the axial hole of the insulator so as to apply a load to the connecting portion forming powder for forming the connecting portion.

The spark plug of the second invention further includes a resistor having a porosity of 5.0% or less. Therefore, there can be provided a spark plug which is excellent in load life performance.

In the case of the spark plug of the first invention and the spark plug of the second invention, the ratio (A/B) of the forward portion diameter (A) to the connecting portion diameter (B) falls within a range of 0.85 to 0.97. Therefore, the porosity of the resistor and/or the above-mentioned shrinkage percentage can be readily adjusted to a specific range. As a result, there can be provided a spark plug which is excellent in terms of load life performance and the fixing strength of the metallic terminal to the insulator.

In the case of the spark plug manufacturing method of the present invention, if the exposure length (H) and the powder portion diameter (B') satisfy the above-described relational expressions (1) to (3) in the third step, the porosity and/or the shrinkage percentage falls within a specific range. Therefore, a spark plug which is excellent in terms of load life performance and the fixing strength of the metallic terminal to the insulator can be readily manufactured.

In the case of the spark plug manufacturing method of the present invention, if the exposure length (H) and the powder portion diameter (B') satisfy a relational expression $H \leq 2.0B' + 22.4$, it is possible to decrease the incidence of defectives due to insulator breakage which occurs when the metallic terminal is inserted into the axial hole of the insulator so as to apply a load to the connecting portion forming powder.

In the case of the spark plug manufacturing method of the present invention, when the powder portion diameter (B') is set to 2.9 mm or less, the effect of improving load life performance is enhanced.

In the case of the spark plug manufacturing method of the present invention, if the ratio (A/B') of the forward portion diameter (A) to the powder portion diameter (B') falls within a range of 0.85 to 0.97, the porosity of the resistor and/or the above-mentioned shrinkage percentage can be readily adjusted to a specific range. As a result, a spark plug which is excellent in terms of load life performance and the fixing strength of the metallic terminal to the insulator can be readily manufactured.

DETAILED DESCRIPTION OF PREFERRED EMBODIMENTS

Figure 1:
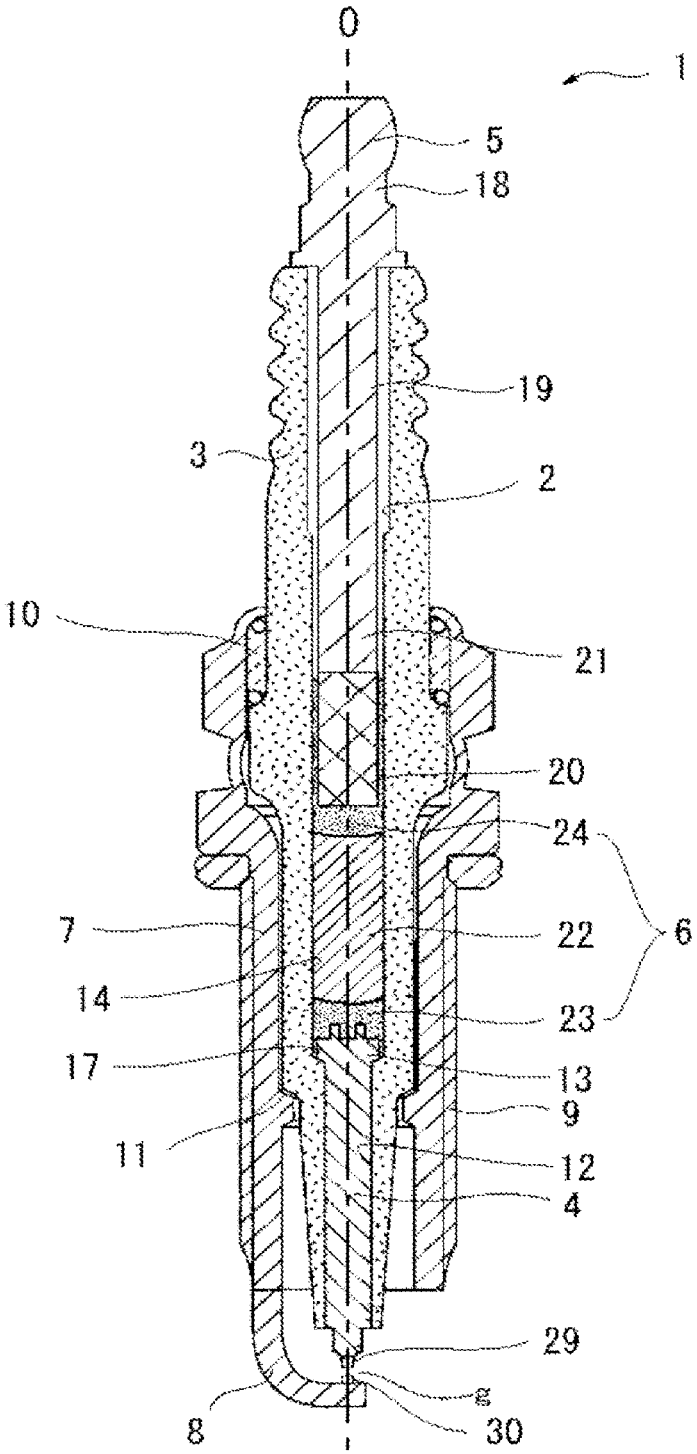
FIG. 1 is an explanatory view showing a cross section of the entirety of a spark plug which is one embodiment of a spark plug according to the present invention.

FIG. 1 shows a spark plug according to one embodiment of the present invention. FIG. 1 is an explanatory sectional view showing the entirety of a spark plug 1 according to one embodiment of the present invention. In FIG. 1, the axis of an insulator is denoted by O. In the following description, the lower side of the sheet on which FIG. 1 is drawn; i.e., the side where a center electrode is held, will be referred to as the forward end side along the axis O, and the upper side of the sheet on which FIG. 1 is drawn; i.e., the side where a metallic terminal is held, will be referred to as the rear end side along the axis O.

Spark plug 1 includes an insulator 3 which has an axial hole 2 extending in the direction of the axis O. A center electrode 4 is held at the forward end of the axial hole 2. A metallic terminal 5 is held at the rear end of the axial hole 2. A connecting portion 6 electrically connects the center electrode 4 and the metallic terminal 5 within the axial hole 2. A metallic shell 7 accommodates the insulator 3. A ground electrode 8 has one end joined to a forward end surface of the metallic shell 7 and another end facing the center electrode 4 with a gap formed therebetween.

The metallic shell 7 has a generally cylindrical shape and is formed to accommodate and hold the insulator 3. A threaded portion 9 is formed on the outer circumferential surface of a forward end portion of the metallic shell 7. The spark plug 1 is attached to the cylinder head of an unillustrated internal combustion engine through use of the threaded portion 9. The metallic shell 7 may be formed of an electrically conductive steel material such as low carbon steel. Preferably, the threaded portion 9 has a size of M12 or less in order to decrease the diameter thereof.

The insulator 3 is held inside the metallic shell 7 via talc 10, a packing 11, etc. The axial hole 2 of the insulator 3 has a small-diameter portion 12 for holding the center electrode 4 on the forward end side along the axis O, and an intermediate-diameter portion 14 which accommodates the connecting portion 6 and which is greater in diameter than the small-diameter portion 12. The axial hole 2 also has a first step portion 13 which is provided between the small-diameter portion 12 and the intermediate-diameter portion 14 and which is tapered such that its diameter increases toward the rear end side. The insulator 3 is fixed to the metallic shell 7 such that a forward end portion of the insulator 3 projects from the forward end surface of the metallic shell 7. The insulator 3 is desirably formed of a material which is sufficiently high in mechanical strength, thermal strength, electrical strength, etc. An example of such a material is a ceramic sintered body containing alumina as a main component.

The center electrode 4 is accommodated in the small-diameter portion 12, and a flange portion 17 provided at the rear end of the center electrode 4 having a larger diameter is engaged with the first step portion 13. Thus, the center electrode 4 is held such that the forward end of the center electrode 4 projects from the forward end surface of the insulator 3, and the center electrode 4 is insulated from the metallic shell 7. The center electrode 4 is desirably formed of a material having a sufficient thermal conductivity, a sufficient mechanical strength, etc. For example, the center electrode 4 is formed of a nickel alloy such as Inconel (trademark). A core portion of the center electrode 4 may be formed of a metallic material which is excellent in thermal conductivity such as Cu or Ag.

The ground electrode 8 is formed into, for example, a generally prismatic shape. The ground electrode 8 is joined at its one end to the forward end surface of the metallic shell 7, and is bent in the middle to have a generally L-like shape. The shape and structure of the ground electrode 8 are designed such that its distal end portion faces a forward end portion of the center electrode 4 with a gap formed therebetween. The ground electrode 8 is formed of the same material as that of the center electrode 4.

Noble metal tips 29 and 30 formed of a platinum alloy, an iridium alloy, or the like may be respectively provided on the surfaces of the center electrode 4 and the ground electrode 8 which face each other. Alternatively, a noble metal tip may be provided on only one of the center electrode 4 and the ground electrode 8. In the spark plug 1 of the present embodiment, both the center electrode 4 and the ground electrode 8 have the noble metal tips 29 and 30 provided thereon, and a spark discharge gap g is formed between the noble metal tips 29 and 30.

The metallic terminal 5 is used to externally apply to the center electrode 4 a voltage for generating spark discharge between the center electrode 4 and the ground electrode 8. The metallic terminal 5 has a first constituent portion 18 and a second constituent portion 19 having a generally circular columnar shape. The first constituent portion 18 has an outer diameter greater than the inner diameter of the axial hole 2 and is exposed from the axial hole 2. A portion of the first constituent portion 18 butts against the end surface of the insulator 3 located on the rear end side with respect to the direction of the axis O. The second constituent portion 19 extends forward from the end surface of the first constituent portion 18 located on the forward end side with respect to the direction of the axis O, and is accommodated in the axial hole 2. The second constituent portion 19 has a forward end portion 20 located on the forward end side along the axis O, and a trunk portion 21 located between the forward end portion 20 and the first constituent portion 18. The forward end portion 20 and the trunk portion 21 of the second constituent portion 19 are accommodated in the intermediate-diameter portion 14. The forward end portion 20 has an uneven surface. In the present embodiment, the outer circumferential surface of the forward end portion 20 is knurled. In the case where the surface of the forward end portion 20 has an uneven structure formed by, for example, knurling, the degree of adhesion between the metallic terminal 5 and the connecting portion 6 increases. As a result, the metallic terminal 5 and the insulator 3 are firmly fixed together. The metallic terminal 5 is formed of, for example, low-carbon steel or the like, and a nickel layer is formed on the surface of the metallic terminal 5 through plating or the like.

The connecting portion 6 is disposed in the axial hole 2 such that it is located between the center electrode 4 and the metallic terminal 5, and electrically connects the center electrode 4 and the metallic terminal 5. The connecting portion 6 includes a resistor 22 and prevents generation of radio noise by the action of the resistor 22. The connecting portion 6 has a first seal layer 23 between the resistor 22 and the center electrode 4 and a second seal layer 24 between the resistor 22 and the metallic terminal 5. The first seal layer 23 fixes the insulator 3 and the center electrode 4 in a sealed condition, and the second seal layer 24 fixes the insulator 3 and the metallic terminal 5 in a sealed condition.

The resistor 22 may be constituted by a resistor member formed by sintering a resistor composition which contains powder of glass such as borosilicate soda glass, powder of ceramic such as $ZrO_2$, electrically conductive nonmetallic powder such as carbon black, and/or powder of metal such as Zn, Sb, Sn, Ag, Ni, etc. The resistor 22 typically has a resistance of 100Ω or higher.

The first seal layer 23 and the second seal layer 24 may be constituted by a seal material which is formed by sintering a seal powder which contains powder of glass such as borosilicate soda glass and powder of metal such as Cu, Fe, etc. Each of the first seal layer 23 and the second seal layer 24 typically has a resistance of 100 mΩ or lower.

Notably, the connecting portion 6 may be formed by the resistor 22 only, without using the first seal layer 23 and the second seal layer 24. The connecting portion 6 may be formed by the resistor 22 and one of the first seal layer 23 and the second seal layer 24. In the following description, the resistor member and/or the seal member constituting the connecting portion 6 may be collectively referred to as a connecting member, and the resistor composition and/or the seal powder used for forming the connecting portion 6 may be collectively referred to as connecting portion forming powder.

In the spark plug of the first invention, the porosity of the resistor 22 of the connecting portion 6 is 5.0% or less, preferably 4.0% or less, more preferably 1.2% or less, and is usually 0.3% or greater. When the porosity of the resistor 22 falls within the above-described range, a spark plug which is excellent in load life performance can be provided. Since the porosity of the resistor 22 is low; i.e., the pores of the resistor are small and the number of the pores is small, a current of high energy applied to the resistor disperses into a plurality of conductive passages formed in the resistor. Thus, presumably, the resistance of the resistor becomes unlikely to increase. When the porosity of the resistor 22 is higher than 5.0%, the resistance of the resistor 22 becomes more likely to increase within a relatively short period of time, and the load life performance becomes poor. Also, when the porosity is high, the resistance becomes likely to be produced in a concentrated manner at a portion, and that portion deteriorates.

Figure 2:
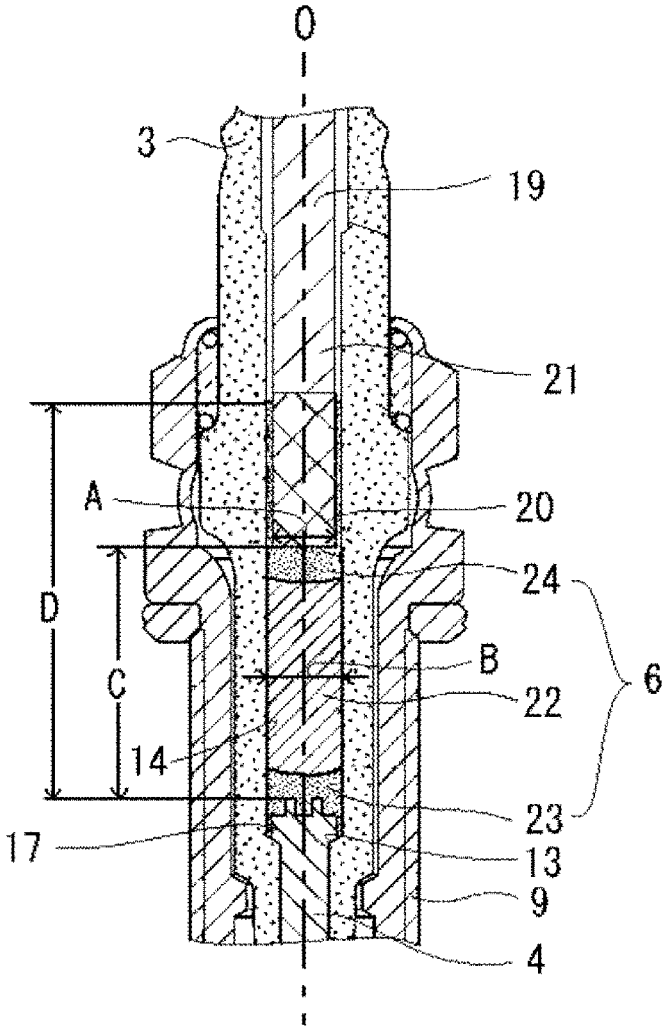
FIG. 2 is an explanatory view showing a cross section of a main portion of the spark plug which is one embodiment of the spark plug according to the present invention.

As shown in FIG. 2, a length from the rear end of the center electrode 4 to the rear end of the seal member which constitutes the second seal layer 24 of the connecting portion 6 is referred to as a charging length (D); and a length from the rear end of center electrode 4 to the forward end of the second constituent portion 19 is referred to as a connecting portion length (C). Preferably, the shrinkage percentage ((D−C)/D)×100, which represents the ratio of the difference between the charging length (D) and the connecting portion length (C) to the charging length (D), falls within a range of 38% and 67%. The present inventors found that, when the shrinkage percentage ((D−C)/D)×100 falls within this range, a resistor having a high density is obtained and the load life performance becomes good. Also, since the connecting member is adequately charged around the forward end portion 20 of the second constituent portion 19, there can be provided a spark plug which is excellent in terms of the fixing strength of the metallic terminal to the insulator. Also, when the shrinkage percentage falls within the above-mentioned range, it is possible to suppress breakage of the insulator 3 which would otherwise occur when the metallic terminal 5 is inserted into the axial hole 2 and a load is applied to the connection portion forming powder for forming the connecting portion 6. Thus, the incidence of defectives can be reduced.

Preferably, the forward end portion 20 of the second constituent portion 19 has an uneven surface, and the ratio (A/B) of a forward end portion diameter (A) to a connecting portion diameter (B) falls within a range of 0.85 to 0.97. The forward end portion diameter (A) is the diameter of the forward end portion 20. The connecting portion diameter (B) is the diameter of the axial hole 2 at a position where the resistor 22 is disposed. When the forward end portion 20 has an uneven surface, the contact area between the forward end portion 20 and the seal member increases, and the adhesion between the forward end portion 20 and the second seal layer 24 becomes satisfactory. Therefore, the metallic terminal 5 and the insulator 3 are firmly fixed together. When the ratio (A/B) falls within the above-mentioned range, the following effect can be provided. When the metallic terminal 5 is inserted into the axial hole 2 and a load is applied to the connecting portion forming powder, the pressure can be effectively transmitted from the metallic terminal 5 to the connecting portion forming powder. Therefore, the above-mentioned porosity and/or the above-mentioned shrinkage percentage can be readily adjusted to a proper range. As a result, there can be provided a spark plug which is excellent in terms of load life performance and the fixing strength of the metallic terminal to the insulator.

In the case of the spark plug of the first invention, when the connecting portion diameter (B) is 2.9 mm or less, the effect of improving the load life performance by setting the porosity to the above-mentioned range is enhanced.

In the case of the spark plug of the second invention, preferably, the shrinkage percentage ((D−C)/D)×100 falls within a range of 35% to 69%. When the shrinkage percentage ((D−C)/D)×100 falls within this range, a resistor having a high density is obtained, whereby excellent load life performance is attained. Also, since the connecting member is adequately charged around the forward end portion 20 of the second constituent portion 19, there can be provided a spark plug which is excellent in terms of the fixing strength of the metallic terminal to the insulator. When the shrinkage percentage ((D−C)/D)×100 is less than 35%, the resistance of the resistor 22 becomes more likely to increase within a relatively short period of time, which results in inferior load life performance. When the shrinkage percentage ((D−C)/D)×100 is less than 69%, it is possible to suppress breakage of the insulator 3 which would otherwise occur when the metallic terminal 5 is inserted into the axial hole 2 and a load is applied to the connection portion forming powder for forming the connecting portion 6.

In the case of the spark plug of the second invention, when the connecting portion diameter (B) is 2.9 mm or less, preferably, the shrinkage percentage ((D−C)/D)×100 falls within a range of 38% to 67%. In the case where the connecting portion diameter (B) is 2.9 mm or less and the shrinkage percentage ((D−C)/D)×100 falls within this range, there can be provided a spark plug which is more excellent in terms of load life performance and the fixing strength of the metallic terminal to the insulator. Also, it is possible to suppress breakage of the insulator 3 to a greater extent, which breakage would otherwise occur when the metallic terminal 5 is inserted into the axial hole 2 and a load is applied to the connection portion forming powder for forming the connecting portion 6.

The porosity of the resistor 22 of the connecting portion 6 is 5.0% or less, preferably 4.0% or less, more preferably 1.2% or less. Usually, the porosity of the resistor is 0.3% or greater.

Preferably, the forward end portion 20 of the second constituent portion 19 has an uneven surface, and the ratio (A/B) of the forward end portion diameter (A) to the connecting portion diameter (B) falls within a range of 0.85 to 0.97. When the forward end portion 20 has an uneven surface, the contact area between the forward end portion 20 and the seal member increases, and the adhesion between the forward end portion 20 and the second seal layer 24 becomes satisfactory. Therefore, the metallic terminal 5 and the insulator 3 are firmly fixed together. When the ratio (A/B) falls within the above-mentioned range, the following effect can be provided. When the metallic terminal 5 is inserted into the axial hole 2 and a load is applied to the connection portion forming powder, the pressure can be effectively transmitted from the metallic terminal 5 to the connection portion forming powder. Therefore, the above-mentioned porosity and/or the above-mentioned shrinkage percentage can be readily adjusted to a proper range. As a result, there can be provided a spark plug which is excellent in terms of load life performance and the fixing strength of the metallic terminal to the insulator.

The porosity can be obtained by the following procedure. The resistor 22 is cut in the direction of the axis O, and mirror polishing is performed for the cut surface. An image of the entire polished surface is obtained through SEM observation (e.g., acceleration voltage: 20 kV, spot size: 50, COMPO image, composition image). The area ratio of pores is measured from the image, whereby the porosity can be obtained. The area ratio of pores can be measured through use of, for example, Analysis Five, which is a product of Soft Imaging System GmbH. When this image analysis software is used, a proper threshold is set so that pores are selected through the entire image of the polished surface.

Each of the above-described dimensions (A) to (D) can be obtained by photographing the spark plug from a direction perpendicular to the axis O using a fluoroscopic apparatus, and measuring the relevant portion. As shown in FIG. 2, the forward end portion diameter (A) is obtained by measuring the dimension (in the direction perpendicular to the axis O) of the second constituent portion 19 at a position shifted 1 mm from the forward end of the second constituent portion 19 toward the rear end side along the axis O. The connecting portion diameter (B) is obtained by measuring the dimension (in the direction perpendicular to the axis O) of the intermediate-diameter portion 14 at a center portion of the resistor 22 with respect to the direction of the axis O. The connecting portion length (C) is obtained by measuring the length (in the direction of the axis O) from the rear end of the center electrode 4 to the forward end of the second constituent portion 19. The charging length (D) is obtained by measuring the length (in the direction of the axis O) from the rear end of the center electrode 4 to the rear end of the seal member constituting the second seal layer 24. The seal member adhering to the inner circumferential surface of the axial hole 2 is observed on the rear end side of the second seal layer 24. The rear end (with respect to the direction of the axis O) of the seal member adhering to the inner circumferential surface of the axial hole 2 serves as the rear end of the seal member. As a result of application of a load and heat, seal powder charged in the axial hole 2 before a fourth step to be described later is compressed, so that the seal powder becomes the seal member which constitutes the second seal layer 24. Meanwhile, a portion of the seal powder adhering to the inner circumferential surface of the axial hole 2 remains as a seal member. Accordingly, the position of the rearmost end of the seal member with respect to the direction of the axis O is considered to be identical with the position of the rear end of the seal powder charged in the axial hole 2 before application of the load and heat. Therefore, the difference (D−C) between the charging length (D) and the connecting portion length (C) represents a shrinkage length by which the connecting portion 6 shrinks in the direction of the axis O in the fourth step.

Notably, in this embodiment, the connecting portion 6 includes the first seal layer 23, the resistor 22, and the second seal layer 24, which are disposed in this sequence from the front end side with respect to the direction of the axis O. However, the embodiment may be modified such that the connecting portion 6 is formed by the resistor 22 only without using the first seal layer 23 and the second seal layer 24, the connecting portion 6 is formed by the resistor 22 and the first seal layer 23, or the connecting portion 6 is formed by the resistor 22 and the second seal layer 24. Accordingly, in the spark plug 1 of the embodiment shown in FIGS. 1 and 2, the substance which remains on and adheres to the inner circumferential surface of the axial hole 2 is the seal member which constitutes the second seal layer 24. However, in the case where the connecting portion 6 is formed by the first seal layer 23 and the resistor 22 without using the second seal layer 24, the resistor member which constitutes the resistor 22 is observed as a substance which remains on and adheres to the inner circumferential surface of the axial hole 2. In this case, the length (in the direction of the axis O) from the rear end of the center electrode 4 to the rearmost end of the resistor member with respect to the direction of the axis O is used as the charging length (D).

For example, the spark plug 1 is manufactured as follows. Of the steps for manufacturing the spark plug 1, the steps of disposing and fixing the insulator, the center electrode, and the metallic terminal will be mainly described (see FIGS. 3A-3D).

First, the center electrode 4, the ground electrode 8, the metallic shell 7, the metallic terminal 5, and the insulator 3 are fabricated by known methods such that they have predetermined shapes (preparing step), and one end portion of the ground electrode 8 is joined to the forward end surface of the metallic shell 7 by laser welding or the like (ground electrode joining step).

Figure 3A:
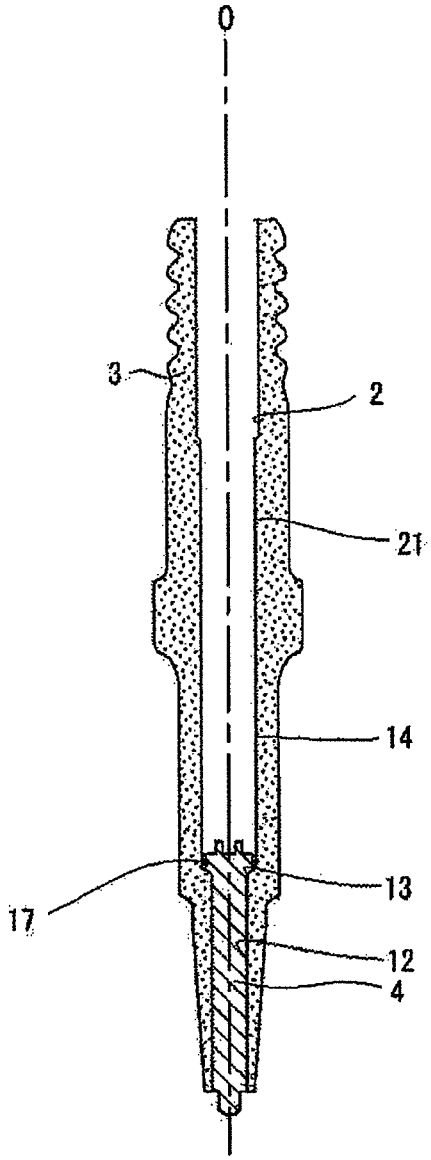
FIGS. 3A, 3B, 3C and 3D are a set of explanatory sectional views which show example steps of a spark plug manufacturing method according to the present invention.

Meanwhile, the center electrode 4 is inserted into the axial hole 2 of the insulator 3, and the flange portion 17 of the center electrode 4 is brought into engagement with the first step portion 13 of the axial hole 2, whereby the center electrode 4 is disposed in the small-diameter portion 12 (first step), as illustrated in FIG. 3A.

Figure 3B:
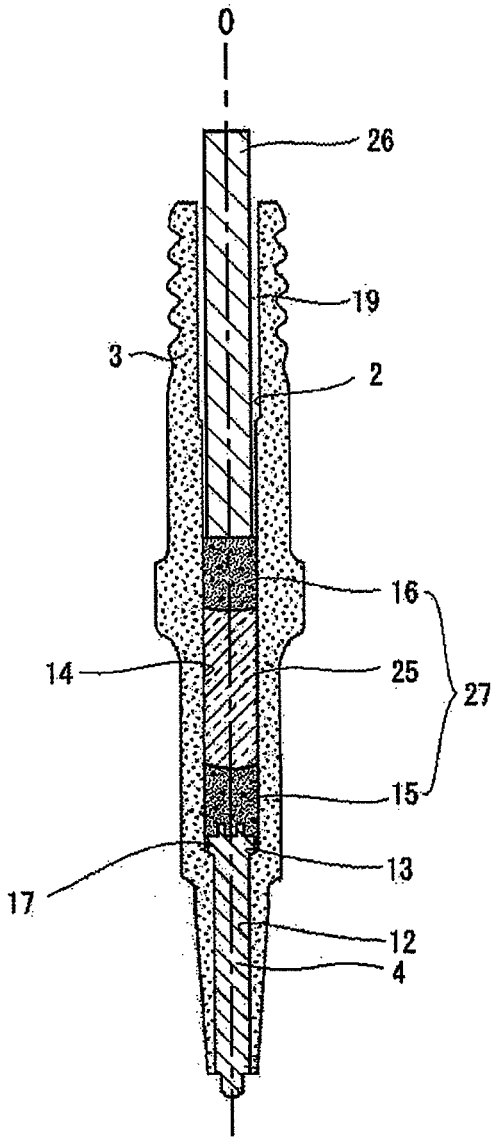

Subsequently, a seal powder 15 which forms the first seal layer 23, a resistor composition 25 which forms the resistor 22, and a seal powder 16 which forms the second seal layer 24 are placed in this sequence into the axial hole 2 from the rear end thereof. Subsequently, a press pin 26 is inserted into the axial hole 2 so as to preliminarily compress them under a pressure of 60 N/mm$^2$ or greater. Thus, the seal powders 15, 16 and the resistor composition 25 are charged into the intermediate-diameter portion 14 (second step), as illustrated in FIG. 3B.

Figure 3C:
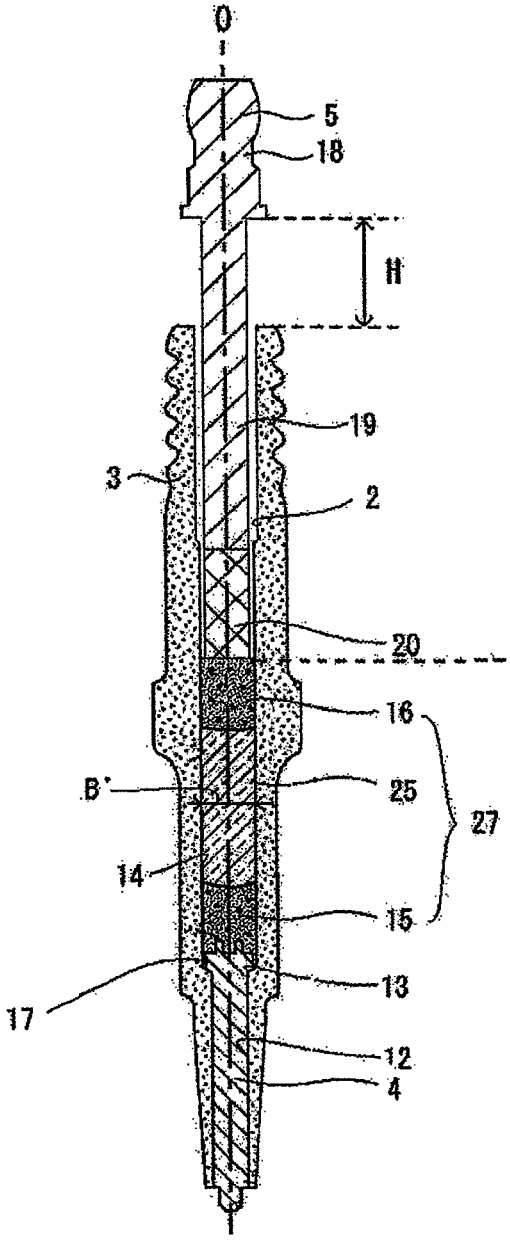

Subsequently, the forward end portion 20 of the metallic terminal 5 is inserted into the axial hole 2 from the rear end thereof, and the metallic terminal 5 is disposed such that the forward end portion 20 comes into contact with the seal powder 16 (third step), as illustrated in FIG. 3C.

Figure 3D:
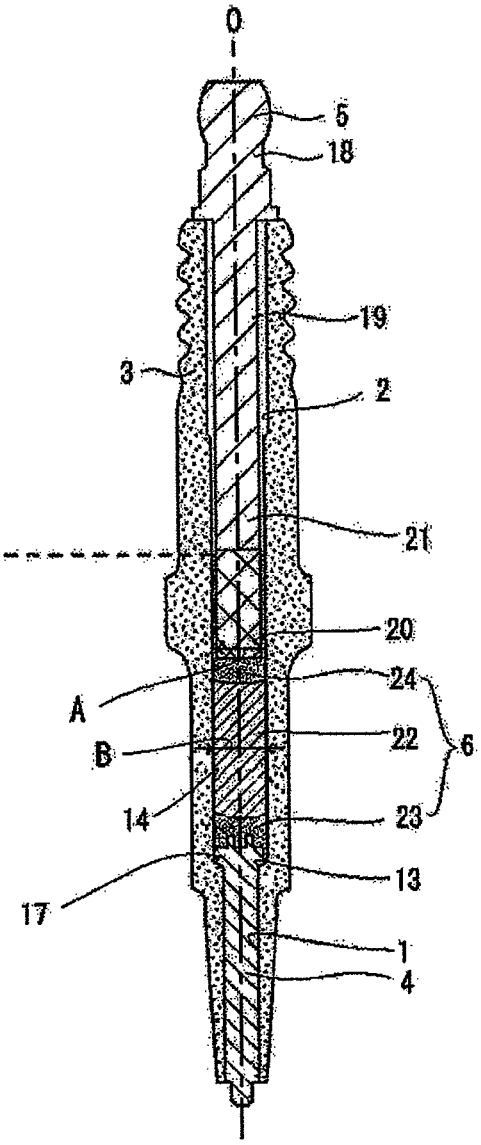

Subsequently, the connection portion forming powder 27 is heated at a temperature equal to higher than the glass softening point of the glass powder contained in the seal powders 15 and 16 (e.g., 800° C. to 1000° C.) for 3 min to 30 min. In this heated state, the metallic terminal 5 is pressed and inserted until the forward end surface of the first constituent portion 18 of the metallic terminal 5 butts against the rear end surface of the insulator 3, whereby a load is applied to the connecting portion forming powder 27 (fourth step), as illustrated in FIG. 3D.

Thus, the seal powders 15, 16 and the resistor composition 25, which together constitute the connecting portion forming powder 27, are sintered, whereby the first seal layer 23, the second seal layer 24, and the resistor 22 are formed. Also, the seal member which constitutes the first seal layer 23 and the second seal layer 24 is charged into the gap between the flange portion 17 and the wall surface of the axial hole 2 and between the forward end portion 20 and the wall surface of the axial hole 2. Thus, the center electrode 4 and the metallic terminal 5 are fixedly disposed in the axial hole 2 in a sealed condition.

Next, the insulator 3, including the center electrode 4, the metallic terminal 5, etc., fixed thereto, is assembled to the metallic shell 7 having the ground electrode 8 joined thereto (assembly step).

Finally, a distal end portion of the ground electrode 8 is bent toward the center electrode 4 such that the distal end of the ground electrode 8 faces the forward end portion of the center electrode 4. Thus, the spark plug 1 is completed.

Notably, the resistor composition 25 and the seal powder 16 having the above-described compositions may be used as the resistor composition 25 and the seal powder 16 which are charged into the axial hole in the above-described second step.

The method of manufacturing a spark plug according to the present invention is characterized in that, in the third step, an exposure length (H) (mm) and a powder portion diameter (B') (mm) satisfy the following relational expressions (1) to (3), where the exposure length (H) is the length (in the direction of the axis O) from the rear end of the insulator 3 to the forward end of the first constituent portion 18, and the powder portion diameter (B') is the diameter of a portion of the axial hole 2 where the connecting portion forming powder 27 is disposed.

$$H \geq -3.1B' + 18 \quad (1)$$

$$H \geq -0.85B' + 11 \quad (2)$$

$$B' \leq 5 \quad (3)$$

Figure 4:
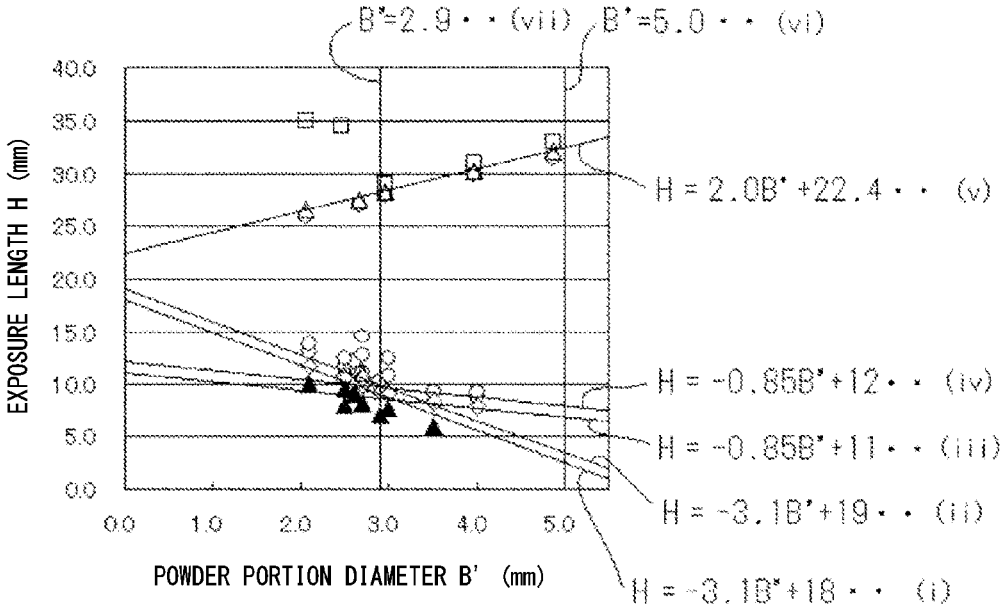
FIG. 4 is a graph showing the relation between powder portion diameter and exposure length.

FIG. 4 shows a graph which shows the above-mentioned relational expressions (1) to (3). When the exposure length (H) and the powder portion diameter (B') satisfy the above-mentioned relational expressions (1) to (3), there can be easily manufactured a spark plug which is excellent in terms of load life performance and the fixing strength of the metallic terminal to the insulator.

The second constituent portion 19 of the metallic terminal 5 disposed in the axial hole 2 in the third step is partially exposed, without being inserted into the axial hole 2, by an amount corresponding to the exposure length (H). In the fourth step, the metallic terminal 5 is pressed and inserted into the axial hole 2 until the exposure length (H) becomes substantially zero, whereby a load is applied to the connecting portion forming powder 27. Therefore, when the exposure length (H) is greater than specific values as shown in the above-mentioned relational expressions (1) and (2), the connecting portion forming powder 27 is properly compressed by the metallic terminal 5 under a heated condition. As a result, the porosity of the formed resistor 22 and the above-described shrinkage percentage fall in proper ranges. That is, there can be obtained a spark plug in which the porosity of the resistor 22 is 5.0% or less and the shrinkage percentage is 35% or greater.

Also, the smaller the powder portion diameter (B'), the lower the strength of the metallic terminal 5. Therefore, the metallic terminal 5 becomes more likely to deform when the metallic terminal 5 is press-inserted into the axial hole 2. Accordingly, in the case where the powder portion diameter (B') falls within the above-described range (3) of $B' \leq 5$, in particular within a range (5) of $B' \leq 2.9$, the exposure length (H) is increased as the powder portion diameter (B') decreases. Thus, the porosity of the resistor 22 and the above-described shrinkage percentage fall within the proper ranges, and load life performance is enhanced. However, in the case where the value of the exposure length (H) is excessively large and falls outside a range (4) of $H \leq 2.0B' + 22.4$, when a load is applied to the connecting portion forming powder 27 by the metallic terminal 5, the insulator 3 may break or crack near the first step portion 13, which may result in an increase in defective incidence.

Preferably, the exposure length (H) and the powder portion diameter (B') further satisfy a relational expression (6) of $H \geq -3.1B' + 19$ when $B' \leq 2.9$, and satisfy a relational expression (7) of $H \geq -0.85B' + 12$ when $B' \geq 2.9$. In the case where the exposure length (H) and the powder portion diameter (B') satisfy the relational expression (6) or (7), there can be manufactured a spark plug which is more excellent in terms of load life performance.

The forward end portion 20 of the metallic terminal 5 is desired to have an uneven surface, and the ratio (A/B') of the forward portion diameter (A) to the powder portion diameter (B') is desired to fall within the range of 0.85 to 0.97. In the case where the surface of the forward end portion 20 has an uneven structure, the contact area between the forward end portion 20 and the seal member increases, and the adhesion between the forward end portion 20 and the second seal layer 24 becomes satisfactory. Therefore, the metallic terminal 5 and the insulator 3 are firmly fixed together. Also, in the case where the ratio (A/B') falls within the above-described range, when a load is applied to the connecting portion forming powder 27 by the metallic terminal 5, a pressure can be transmitted effectively. Thus, there can be manufactured a spark plug which has an adequate porosity of the resistor and/or an adequate shrinkage percentage. Accordingly, there can be easily manufactured a spark plug which is excellent in terms of load life performance and the fixing strength of the metallic terminal to the insulator.

The powder portion diameter (B') can be obtained by photographing the spark plug from a direction perpendicular to the axis O using a fluoroscopic apparatus, and measuring the diameter of the axial hole 2 at a central portion between the rear end of the center electrode 4 and the forward end portion of the metallic terminal 5.

The spark plug according to the present invention is used as an ignition plug for an internal combustion engine (e.g., a gasoline engine) for automobiles. The above-mentioned threaded portion 9 is screwed into a threaded hole provided in a head (not shown) which defines and forms combustion chambers of the internal combustion engine, whereby the spark plug is fixed at a predetermined position. Although the spark plug according to the present invention can be used for any internal combustion engine, the spark plug finds advantageous application with an internal combustion engine in which the space for spark plugs is required to reduce, because the present invention provides a remarkable effect when it is applied to spark plugs having a reduced diameter.

The spark plug of the present invention is not limited to the above-described embodiment, and various modifications are possible within a range in which the object of the present invention can be achieved. For example, in the case of the spark plug 1, the forward end portion 20 of the metallic terminal 5 is knurled. However, no particular limitation is imposed on the method of processing the surface of the forward end portion 20 so long as the surface of the forward end portion 20 has a shape (e.g., an uneven shape) which enhances the adhesion between the forward end portion 20 and the seal member. For example, the surface of the forward end portion 20 may have a shape formed by threading or the like. Also, the entire outer circumferential surface of the forward end portion 20 may have an uneven shape or a portion of the surface may have an uneven shape.

EXAMPLES

Manufacture of Spark Plug

The spark plug shown in FIG. 1 was manufactured in accordance with the above-described manufacturing process. The seal powder charged in the axial hole of the insulator in the second step was powder which contained glass powder in an amount of 50% by mass and an electrically conductive component (metal powder) in an amount of 50% by mass. The resistor composition was powder which contained glass powder in an amount of 80% by mass, ceramic powder in an amount of 15% by mass, and carbon black in an amount of 5% by mass.

The seal powder and the resistor composition charged into the axial hole were preliminarily compressed through use of a press pin under a pressure of 100 N/mm$^2$. In the fourth step, the connecting portion forming powder constituting the resistor composition and the seal powder was heated at 900° C. for 10 min, and the metallic terminal was inserted into the axial hole in the heated state.

Spark plugs were manufactured while the forward portion diameter (A), the connecting portion diameter (B), the powder portion diameter (B'), the connecting portion length (C), the charging length (D), and the exposure length (H) were changed, i.e., varied, as shown in Tables 1 to 3.

The above-mentioned various dimensions were measured through use of a fluoroscopic apparatus and a vernier caliper as described above. The powder portion diameter (B') and the connecting portion diameter (B) were the same.

The porosity of the resistor in each of the manufactured spark plugs was obtained by the above-described method. That is, from an SEM image of a half section of the resistor (SEM (model: JSM-6460LA) of JEOL Ltd (acceleration voltage: 20 kV, spot size: 50, COMPO image, composition image)), the area ratio of pores was measured through use of Analysis Five, which is a product of Soft Imaging System GmbH.

Evaluation Method (Load Life Performance Test)

Each of the manufactured spark plugs was placed in an environment of 350° C., and a discharge voltage of 20 kV was applied thereto so as to generate discharge 3600 times over 1 min. The resistance $R_0$ of the resistor of each spark plug before this test and the resistance $R_1$ of the resistor after this test were measured. This test was carried out 10 times, and the time at which the ratio ($R_1/R_0$) of the average of the resistances $R_1$ after the test to the initial resistance $R_0$ become 1.5 or greater was measured. The longer the time, the better the load life performance. Evaluation results are shown in Tables 1 and 2.

(Load Life Performance Under Severe Test Conditions)

A test was performed in the same manner as in the above-described load life performance test, except that the discharge voltage was set to 25 kV. The evaluation results are shown in Table 3.

(Evaluation of the Incidence of Defectives Due to Insulator Breakage)

When 50 spark plugs were manufactured, spark plugs whose insulators were broken during the manufacturing process were determined to be defective. The ratio of spark plugs determined defectives was evaluated in accordance with the following criteria. The evaluation results are shown in Tables 1 and 2.

C: 30% or higher

B: not less than 5% but lower than 30%

A: higher than 0% but lower than 5%

AA: 0%

(Terminal Fixing Strength Test)

The first constituent portion of the metallic terminal was clamped by a jig, and this jig was pulled by an autograph. The strength at which the metallic terminal was removed from the insulator was measured. The terminal fixing strength was evaluated in accordance with the following criteria. The evaluation results are shown in Tables 1 and 2.

B: not less than 2500 N but less than 3000 N

A: not less than 3000 N but less than 3500 N

AA: not less than 3500 N, or the metallic terminal was broken.

TABLE 1

| No. | Porosity (%) | Connecting portion length C (mm) | Charging length D (mm) | Shrinkage percentage (D − C)/D (%) | Forward portion diameter A (mm) | Connecting portion diameter B Powder portion diameter B' (mm) | A/B (A/B') | Exposure length H (mm) | Evaluation results: Load life NG generation time (h) | Evaluation results: Defective incidence | Evaluation results: Terminal fixing strength |
|---|---|---|---|---|---|---|---|---|---|---|---|
| 1 Example | 3.6 | 12.9 | 20.8 | 38.0 | 1.89 | 2.1 | 0.90 | 13.0 | 500 | AA | AA |
| 2 | 4.5 | 13.5 | 21.1 | 36.0 | 1.89 | 2.1 | 0.90 | 11.6 | 150 | AA | AA |

TABLE 1-continued

| No. | | Porosity (%) | Connecting portion length C (mm) | Charging length D (mm) | Shrinkage percentage (D − C)/D (%) | Forward portion diameter A (mm) | Connecting portion diameter B Powder portion diameter B' (mm) | A/B (A/B') | Exposure length H (mm) | Evaluation results: Load life NG generation time (h) | Defective incidence | Terminal fixing strength |
|---|---|---|---|---|---|---|---|---|---|---|---|---|
| 3 | Comparative Example | 5.5 | 14.7 | 22.5 | 34.7 | 1.89 | 2.1 | 0.90 | 10.0 | 1 | AA | A |
| 4 | Example | 3.6 | 12.8 | 21.0 | 39.0 | 2.20 | 2.5 | 0.88 | 11.5 | 460 | AA | AA |
| 5 | | 4.3 | 13.2 | 21.2 | 37.7 | 2.20 | 2.5 | 0.88 | 10.9 | 170 | AA | AA |
| 6 | | 4.5 | 13.7 | 21.1 | 35.1 | 2.20 | 2.5 | 0.88 | 10.5 | 150 | AA | AA |
| 7 | Comparative | 7.4 | 14.0 | 21.1 | 33.6 | 2.20 | 2.5 | 0.88 | 9.4 | 10 | AA | A |
| 8 | Example | 9.2 | 14.3 | 21.3 | 32.9 | 2.20 | 2.5 | 0.88 | 8.0 | 1 | AA | B |
| 9 | Example | 3.3 | 12.4 | 20.8 | 40.4 | 2.34 | 2.6 | 0.90 | 12.0 | >500 | AA | AA |
| 10 | | 4.1 | 13.1 | 21.0 | 37.6 | 2.34 | 2.6 | 0.90 | 10.0 | 200 | AA | AA |
| 11 | Comparative Example | 6.0 | 14.3 | 21.3 | 32.9 | 2.34 | 2.6 | 0.90 | 9.0 | 10 | AA | B |
| 12 | Example | 0.5 | 11.7 | 21.4 | 45.3 | 2.51 | 2.7 | 0.93 | 14.5 | >500 | AA | AA |
| 13 | Example | 3.5 | 12.6 | 21.5 | 41.4 | 2.51 | 2.7 | 0.93 | 12.7 | >500 | AA | AA |
| 14 | | 4.0 | 12.7 | 21.1 | 39.8 | 2.51 | 2.7 | 0.93 | 11.0 | 500 | AA | AA |
| 15 | | 4.7 | 13.0 | 20.9 | 37.8 | 2.51 | 2.7 | 0.93 | 9.8 | 160 | AA | AA |
| 16 | Comparative Example | 7.9 | 14.3 | 21.0 | 31.9 | 2.51 | 2.7 | 0.93 | 8.1 | 5 | AA | B |
| 17 | Example | 3.8 | 12.8 | 21.0 | 39.0 | 2.61 | 2.9 | 0.90 | 10.3 | 500 | AA | AA |
| 18 | | 4.3 | 13.6 | 21.0 | 35.2 | 2.61 | 2.9 | 0.90 | 9.1 | 250 | AA | AA |
| 19 | Comparative Example | 6.2 | 14.0 | 20.8 | 32.7 | 2.61 | 2.9 | 0.90 | 7.0 | 15 | AA | B |
| 20 | Example | 3.0 | 12.0 | 21.5 | 44.2 | 2.79 | 3.0 | 0.93 | 12.3 | >500 | AA | AA |
| 21 | | 3.4 | 12.3 | 21.3 | 42.3 | 2.79 | 3.0 | 0.93 | 10.7 | >500 | AA | AA |
| 22 | | 4.5 | 13.9 | 21.4 | 35.0 | 2.79 | 3.0 | 0.93 | 9.0 | 250 | AA | AA |
| 23 | Comparative Example | 5.2 | 14.2 | 21.3 | 33.3 | 2.79 | 3.0 | 0.93 | 7.7 | 25 | AA | A |
| 24 | Example | 3.6 | 13.0 | 21.5 | 39.5 | 3.15 | 3.5 | 0.90 | 9.1 | 500 | AA | AA |
| 25 | | 4.5 | 13.8 | 21.3 | 35.2 | 3.15 | 3.5 | 0.90 | 8.2 | 150 | AA | AA |
| 26 | Comparative Example | 6.0 | 15.0 | 21.1 | 28.9 | 3.15 | 3.5 | 0.90 | 6.0 | 10 | AA | B |
| 27 | Example | 4.3 | 13.8 | 21.3 | 35.2 | 3.60 | 4.0 | 0.90 | 7.8 | 180 | AA | AA |
| 28 | | 3.8 | 13.5 | 22.0 | 38.6 | 3.60 | 4.0 | 0.90 | 8.7 | 500 | AA | AA |
| 29 | | 3.3 | 13.2 | 22.2 | 40.5 | 3.60 | 4.0 | 0.90 | 9.2 | >500 | AA | AA |

TABLE 2

| No. | | Porosity (%) | Connecting portion length C (mm) | Charging length D (mm) | Shrinkage percentage (D − C)/D (%) | Forward portion diameter A (mm) | Connecting portion diameter B Powder portion diameter B' (mm) | A/B (A/B') | Exposure length H (mm) | Evaluation results: Load life NG generation time (h) | Defective incidence | Terminal fixing strength |
|---|---|---|---|---|---|---|---|---|---|---|---|---|
| 30 | Example | 5.0 | 13.8 | 21.3 | 35.2 | 2.24 | 2.7 | 0.83 | 10.5 | 150 | AA | AA |
| 31 | | 4.5 | 13.3 | 21.1 | 37.0 | 2.30 | 2.7 | 0.85 | 10.5 | 300 | AA | AA |
| 32 | | 3.4 | 12.6 | 21.1 | 40.3 | 2.57 | 2.7 | 0.95 | 11.0 | >500 | AA | AA |
| 33 | | 3.3 | 12.4 | 21.5 | 42.3 | 2.62 | 2.7 | 0.97 | 11.0 | >500 | A | AA |
| 34 | | 3.1 | 11.6 | 21.3 | 45.5 | 2.65 | 2.7 | 0.98 | 11.0 | >500 | B | AA |
| 35 | | 1.5 | 15.0 | 31.0 | 51.6 | 1.81 | 2.1 | 0.86 | 26.0 | >500 | A | AA |
| 36 | | 1.2 | 15.0 | 31.0 | 51.6 | 1.81 | 2.1 | 0.86 | 26.5 | >500 | B | AA |
| 37 | | 1.0 | 10.1 | 30.2 | 66.6 | 2.30 | 2.7 | 0.85 | 27.0 | >500 | A | AA |
| 38 | | 0.8 | 10.0 | 30.3 | 67.0 | 2.30 | 2.7 | 0.85 | 27.5 | >500 | B | AA |
| 39 | | 1.1 | 10.3 | 31.0 | 66.8 | 2.58 | 3.0 | 0.86 | 27.9 | >500 | A | AA |
| 40 | | 0.7 | 10.3 | 31.0 | 66.8 | 2.58 | 3.0 | 0.86 | 28.3 | >500 | B | AA |
| 41 | | 0.7 | 11.0 | 35.3 | 68.8 | 3.44 | 4.0 | 0.86 | 29.9 | >500 | A | AA |
| 42 | | 0.5 | 11.0 | 35.3 | 68.8 | 3.44 | 4.0 | 0.86 | 30.3 | >500 | B | AA |
| 43 | | 0.4 | 11.9 | 38.0 | 68.7 | 4.21 | 4.9 | 0.86 | 31.5 | >500 | A | AA |
| 44 | | 0.3 | 11.8 | 38.1 | 69.0 | 4.21 | 4.9 | 0.86 | 32.0 | >500 | B | AA |
| 45 | | 3.4 | 13.1 | 21.9 | 40.2 | 1.89 | 2.1 | 0.90 | 13.8 | >500 | A | AA |
| 46 | | 3.3 | 13.2 | 22.0 | 40.0 | 2.20 | 2.5 | 0.88 | 12.3 | >500 | A | AA |
| 47 | | 0.5 | 9.8 | 33.1 | 70.4 | 1.89 | 2.1 | 0.90 | 35.0 | >500 | C | AA |
| 48 | | 0.4 | 10.1 | 33.7 | 70.0 | 2.20 | 2.5 | 0.88 | 34.5 | >500 | C | AA |
| 49 | | 0.4 | 9.3 | 31.0 | 70.0 | 2.58 | 3.0 | 0.86 | 29.0 | >500 | C | AA |

TABLE 2-continued

| No. | Porosity (%) | Connecting portion length C (mm) | Charging length D (mm) | Shrinkage percentage (D − C)/D (%) | Forward portion diameter A (mm) | Connecting portion diameter B Powder portion diameter B' (mm) | A/B (A/B') | Exposure length H (mm) | Evaluation results: Load life NG generation time (h) | Defective incidence | Terminal fixing strength |
|---|---|---|---|---|---|---|---|---|---|---|---|
| 50 | 0.4 | 10.6 | 35.3 | 70.0 | 3.44 | 4.0 | 0.86 | 31.0 | >500 | C | AA |
| 51 | 0.3 | 11.0 | 38.0 | 71.1 | 4.21 | 4.9 | 0.86 | 33.0 | >500 | C | AA |

TABLE 3

| No. | Porosity (%) | Connecting portion length C (mm) | Charging length D (mm) | Shrinkage percentage (D − C)/D (%) | Forward portion diameter A (mm) | Connecting portion diameter B Powder portion diameter B' (mm) | A/B (A/B') | Exposure length H (mm) | Evaluation result Load life NG generation time (h) |
|---|---|---|---|---|---|---|---|---|---|
| 52 Example | 2.2 | 12.4 | 21.0 | 41.0 | 2.7 | 2.9 | 0.93 | 10.8 | 260 |
| 53 | 2.0 | 12.3 | 21.0 | 41.4 | 2.7 | | 0.93 | 11.1 | 260 |
| 54 | 1.5 | 12.1 | 21.0 | 42.4 | 2.7 | | 0.93 | 11.3 | 280 |
| 55 | 1.2 | 11.8 | 20.7 | 43.0 | 2.7 | | 0.93 | 11.5 | >500 |
| 56 | 1.0 | 11.7 | 20.8 | 43.8 | 2.7 | | 0.93 | 11.8 | >500 |
| 57 | 0.9 | 11.5 | 20.7 | 44.4 | 2.7 | | 0.93 | 12.0 | >500 |
| 58 | 0.8 | 11.8 | 21.4 | 44.9 | 2.7 | | 0.93 | 12.2 | >500 |
| 59 | 0.6 | 11.5 | 21.0 | 45.2 | 2.7 | | 0.93 | 12.5 | >500 |
| 60 | 0.4 | 11.3 | 20.8 | 45.7 | 2.7 | | 0.93 | 13.0 | >500 |
| 61 | 2.2 | 12.4 | 21.0 | 41.0 | 2.3 | 2.5 | 0.92 | 11.7 | 280 |
| 62 | 2.0 | 12.4 | 21.3 | 41.8 | 2.3 | | 0.92 | 11.9 | 300 |
| 63 | 1.5 | 12.2 | 21.2 | 42.5 | 2.3 | | 0.92 | 12.1 | 300 |
| 64 | 1.2 | 11.9 | 20.8 | 42.8 | 2.3 | | 0.92 | 12.3 | >500 |
| 65 | 1.0 | 11.8 | 21.0 | 43.8 | 2.3 | | 0.92 | 12.5 | >500 |
| 66 | 0.9 | 11.9 | 21.4 | 44.4 | 2.3 | | 0.92 | 13.0 | >500 |
| 67 | 0.8 | 11.7 | 21.2 | 44.8 | 2.3 | | 0.92 | 13.2 | >500 |
| 68 | 0.6 | 11.3 | 20.8 | 45.7 | 2.3 | | 0.92 | 13.5 | >500 |
| 69 | 0.4 | 11.1 | 20.9 | 46.9 | 2.3 | | 0.92 | 13.8 | >500 |
| 70 | 2.2 | 12.6 | 21.3 | 40.8 | 3.3 | 3.5 | 0.94 | 9.7 | 400 |
| 71 | 2.0 | 12.4 | 21.1 | 41.2 | 3.3 | | 0.94 | 10.0 | 400 |
| 72 | 1.5 | 12.4 | 21.3 | 41.8 | 3.3 | | 0.94 | 10.2 | 420 |
| 73 | 1.2 | 12.3 | 21.2 | 42.0 | 3.3 | | 0.94 | 10.5 | >500 |
| 74 | 1.0 | 12.1 | 20.9 | 42.1 | 3.3 | | 0.94 | 11.0 | >500 |
| 75 | 0.9 | 12.0 | 21.1 | 43.1 | 3.3 | | 0.94 | 11.2 | >500 |
| 76 | 0.8 | 12.0 | 21.2 | 43.4 | 3.3 | | 0.94 | 11.5 | >500 |
| 77 | 0.6 | 11.8 | 21.0 | 43.8 | 3.3 | | 0.94 | 11.7 | >500 |
| 78 | 0.4 | 11.6 | 20.8 | 44.2 | 3.3 | | 0.94 | 12.2 | >500 |

As shown in Tables 1 to 3, the spark plugs falling within the range of the present invention were excellent in load life performance and the fixing strength of the metallic terminal to the insulator. Meanwhile, in the case of the spark plugs falling outside the range of the present invention, the resistance of the resistor increased in the load life performance test, and the time before the ratio ($R_1/R_0$) become 1.5 or greater was short. Therefore, these spark plugs were poor in load life performance, and also poor in the fixing strength of the metallic terminal to the insulator.

FIG. 4 is a graph showing the relation between the exposure length (H) and the powder portion diameter (B'). The evaluation results shown in Tables 1 and 2 are classified in accordance with the following criteria, and are represented by different types of symbols.

White circle: the time before the ratio $R_1/R_0$ became 1.5 or greater was longer than 250 hours, the evaluation result of the defective incidence is "AA" or "A," and the evaluation result of the terminal fixing strength test is "AA."

White rhombus: the time before the ratio $R_1/R_0$ became 1.5 or greater was longer than 50 hours but not longer than 250 hours, the evaluation result of the defective incidence is "AA," and the evaluation result of the terminal fixing strength test is "AA."

White triangle: the time before the ratio $R_1/R_0$ became 1.5 or greater was longer than 250 hours, the evaluation result of the defective incidence is "B," and the evaluation result of the terminal fixing strength test is "AA."

White square: the time before the ratio $R_1/R_0$ became 1.5 or greater was longer than 250 hours, the evaluation result of the defective incidence is "C," and the evaluation result of the terminal fixing strength test is "AA."

Black triangle: the time before the ratio $R_1/R_0$ became 1.5 or greater was not longer than 50 hours, the evaluation result of the defective incidence is "AA," and the evaluation result of the terminal fixing strength test is "A" or "B."

When lines which serve the boundary between "black triangles" and "white rhombuses"; the boundary between "white rhombuses" and "white circles"; and the boundary between "white circles" and "white triangles," and "white squares" were drawn, the following five relational expressions were obtained.

$$H=-3.1B'+18 \quad \text{(i)}$$

$$H=-3.1B'+19 \quad \text{(ii)}$$

$$H=-0.85B'+11 \quad \text{(iii)}$$

$$H=-0.85B'+12 \quad \text{(iv)}$$

$$H=2.0B'+22.4 \quad \text{(v)}$$

As shown in FIG. 4, when the exposure length (H) and the powder portion diameter (B') were located in a region surrounded by the above-described two relational expressions (i) and (iii), and the following relational expression (vi), obtained spark plugs were excellent in terms of load life performance and the fixing strength of the metallic terminal to the insulator.

$$B'=5 \quad \text{(vi)}$$

Satisfactory valuation results were not obtained unless the lower limit of the exposure length (H) was increased as the powder portion diameter (B') decreased, and the inclination of a boundary line showing the lower limit of the exposure length (H) for obtaining satisfactory evaluation results changed at a point represented by the following relational expression (vii). In other words, in the case where B'≤2.9, satisfactory evaluation results were obtained when the value of the exposure length (H) was greater than the above-described relational expression (i), in particular, when the value of the exposure length (H) was greater than the above-described relational expression (ii). In the case where B'≥2.9, satisfactory evaluation results were obtained when the value of the exposure length (H) was greater than the above-described relational expression (iii), in particular, when the value of the exposure length (H) was greater than the above-described relational expression (iv). Also, when the value of the exposure length (H) was smaller than the above-described relational expression (v), the defective incidence was low.

$$B'=2.9 \quad \text{(vii)}$$

The invention claimed is:

1. A spark plug comprising:

an insulator having an axial hole extending in a direction of an axis;

a center electrode held at one end of the axial hole;

a metallic terminal held at the other end of the axial hole; and a connecting portion which electrically connects the center electrode and the metallic terminal within the axial hole, a connecting portion diameter (B), which is a diameter of the axial hole at a position where the resistor is disposed, being 2.9 mm or less, the connecting portion including a resistor having a porosity of not more than 5.0%.

2. The spark plug according to claim 1, wherein the porosity of the resistor is not more than 4.0%.

3. The spark plug according to claim 1 or 2, wherein the porosity of the resistor is not more than 1.2% or less.

4. A spark plug comprising:

an insulator having an axial hole extending in a direction of an axis;

a center electrode held at one end of the axial hole;

a metallic terminal held at the other end of the axial hole; and a connecting portion which electrically connects the center electrode and the metallic terminal within the axial hole, the connecting portion including a resistor having a porosity of not more than 5.0%, wherein the metallic terminal has a second constituent portion which is accommodated in the axial hole;

wherein the other end of the axial hole is defined as the rear end side with respect to the direction of the axis; and wherein a shrinkage percentage, defined by the relationship ((D−C)/D)×100 falls within a range of 38% to 67%, where (D) is a charging length defined from the rear end of the center electrode to the rear end of a connecting member and where (C) is a connecting portion length defined from the rear end of the center electrode to the forward end of the second constituent portion.

5. A spark plug comprising:

an insulator having an axial hole extending in a direction of an axis;

a center electrode held at one end of the axial hole;

a metallic terminal which has a second constituent portion accommodated in the axial hole and which is held at the other end of the axial hole, said other end of the axial hole being defined as the rear end side with respect to the direction of the axis; and a connecting portion which electrically connects the center electrode and the metallic terminal within the axial hole, said connecting portion including at least a resistor, wherein a shrinkage percentage, defined by the relationship ((D−C)/D)×100 is at least 35%, where (D) is a charging length defined from the rear end of the center electrode to the rear end of a connecting member which constitutes the connecting portion and where (C) is a connecting portion length defined from the rear end of the center electrode to the forward end of the second constituent portion.

6. The spark plug according to claim 5, wherein the shrinkage percentage ((D−C)/D)×100 is not greater than 69%.

7. The spark plug according to claim 5 or 6, wherein the resistor has a porosity of not more than 5.0%.

8. The spark plug according to claim 5 or 6, wherein a connecting portion diameter (B), which is a diameter of the axial hole at a position where the resistor is disposed, is 2.9 mm or less, and the shrinkage percentage ((D−C)/D)×100 falls within a range of 38% to 67%.

9. The spark plug according to claim 8, wherein a forward end portion of the second constituent portion has an uneven surface; and a ratio (A/B) of a forward end portion diameter (A), which is a diameter of the forward end portion, to the connecting portion diameter (B) falls within a range of 0.85 to 0.97.

10. A method of manufacturing a spark plug, said spark plug comprised of:

an insulator having an axial hole extending in a direction of an axis;

a center electrode held at one end of the axial hole;

a metallic terminal which has a first constituent portion exposed from the axial hole and which is held at the other end of the axial hole; and a connecting portion which electrically connects the center electrode and the metallic terminal within the axial hole, the method comprising:

a first step of disposing a center electrode at the one end of an axial hole in an insulator;

a second step of charging a connecting-portion-forming powder for forming the connecting portion into said axial hole;

a third step of disposing a forward end portion of a metallic terminal in the axial hole such that a forward end portion comes into contact with the connecting-portion-forming powder and the following relational expressions (1) to (3):

$$H \geq -3.1B' + 18 \quad (1)$$

$$H \geq -0.85B' + 11 \quad (2)$$

$$B' \leq 5 \quad (3)$$

are satisfied;

wherein, with the side of the axial hole at which the center electrode is disposed being defined as the forward end side with respect to the direction of the axis, "H" is an exposure length defined in mm from the rear end of the insulator to the forward end of the first constituent portion in the direction of the axis, and "B'" is a powder portion diameter of the axial hole at a position where the connecting portion forming powder is disposed; and a fourth step of heating the connecting-portion-forming powder and applying a load thereto through the metallic terminal.

11. The method of manufacturing a spark plug according to claim 10, wherein the exposure length (H) (mm) and the powder portion diameter (B') (mm) satisfy a relational expression $H \leq 2.0B' + 22.4$.

12. The method of manufacturing a spark plug according to claim 10 or 11, wherein the powder portion diameter (B') (mm) satisfies a relational expression $B' \leq 2.9$.

13. The method of manufacturing a spark plug according to claim 12, wherein the exposure length (H) (mm) and the powder portion diameter (B') (mm) satisfy a relational expression $H \geq -3.1B' + 19$.

14. The method of manufacturing a spark plug according to any one of claim 10, 11, or 13, wherein a forward end portion of the metallic terminal has an uneven surface; and a ratio (A/B') of a forward end portion diameter (A), which is a diameter of the forward end portion, to the powder portion diameter (B') falls within a range of 0.85 to 0.97.

* * * * *